US010183385B2

(12) United States Patent
Chen

(10) Patent No.: US 10,183,385 B2
(45) Date of Patent: Jan. 22, 2019

(54) LOCKING STRUCTURE FOR HAND TOOL

(71) Applicant: Tzu-Chun Chen, Taichung (TW)

(72) Inventor: Tzu-Chun Chen, Taichung (TW)

(73) Assignee: YUNG FONG TOOLS CO., LTD., Taichung (TW)

( * ) Notice: Subject to any disclaimer, the term of this patent is extended or adjusted under 35 U.S.C. 154(b) by 262 days.

(21) Appl. No.: 15/246,551

(22) Filed: Aug. 25, 2016

(65) Prior Publication Data

US 2018/0056491 A1 Mar. 1, 2018

(51) Int. Cl.
*B25B 23/00* (2006.01)
*B25B 13/46* (2006.01)

(52) U.S. Cl.
CPC ..... *B25B 23/0035* (2013.01); *B25B 13/462* (2013.01)

(58) Field of Classification Search
CPC ... B25B 23/0035; B25B 13/462; B25B 13/46; B25B 13/461
See application file for complete search history.

(56) References Cited

U.S. PATENT DOCUMENTS 5,848,561 A * 12/1998 Hsieh ..... B25B 13/462 81/59.1
9,038,506 B1 * 5/2015 Huang ..... B25B 13/462 81/60
2012/0291594 A1 * 11/2012 Li ..... B25B 13/463 81/60
2014/0290441 A1 * 10/2014 Ludtke ..... B25B 13/462 81/60
2015/0075332 A1 * 3/2015 Chen ..... B25B 23/0035 81/60

* cited by examiner

*Primary Examiner* — Christopher R Harmon

(57) ABSTRACT

A locking structure for a hand tool contains: a body having a driving head which includes an accommodation chamber and a rib, and between two ends of the rib is defined an opening. The rib has two positioning orifices, the accommodation chamber has an obliquely arcuate groove accommodating a ratchet member which has a toothed rim and two opposite apertures, and a part of each steel ball extends out of each aperture. The ratchet member further has a first trench, a polygonal groove, and a second trench. A cap is covered on the rib and includes a through orifice, an open section, a protruded section, an actuation extension, and two opposite openings so as to house two posts respectively, wherein a part of each post extends out of each opening, and a resilient element is defined between the second trench and the cap.

4 Claims, 15 Drawing Sheets

LOCKING STRUCTURE FOR HAND TOOL

FIELD OF THE INVENTION

The present invention relates to a locking structure for a hand tool which retains with and removes from a connection column quickly by way of a ratchet member, a cap, and two steel balls housed in the ratchet member.

BACKGROUND OF THE INVENTION

A conventional hand tool, such as ratchet wrench, fits with variety of connection column, such as a socket. The ratchet wrench contains a steel ball accommodated in the polygonal groove of the ratchet member of the ratchet wrench so as to retain with the socket after the socket inserts into the polygonal groove.

However, it is difficult to retain or remove the socket with or from the steel ball.

The present invention has arisen to mitigate and/or obviate the afore-described disadvantages.

SUMMARY OF THE INVENTION

The primary objective of the present invention is to provide a locking structure for a hand tool which retains with and removes from a connection column quickly by way of a ratchet member, a cap, and two steel balls housed in the ratchet member.

To obtain above-mentioned objective, locking structure for a hand tool provided by the present invention contains: a body including a driving head, and the driving head has an accommodation chamber defined in the driving head, a rib extending upwardly on the driving head adjacent to the accommodation chamber, and between two ends of the rib is defined an opening, the rib has two positioning orifices arranged adjacent to the two ends of the rib, respectively.

The accommodation chamber has an obliquely arcuate groove formed on a lower end of the accommodation chamber and accommodating a ratchet member, wherein the ratchet member has a toothed rim arranged around a peripheral wall of the ratchet member, two opposite apertures defined on the peripheral wall of the ratchet member below the toothed rim and configured to accommodate two steel balls, respectively, wherein a part of each of the two steel balls extends out of each of the two apertures, and the ratchet member further has a first trench defined on the peripheral wall of the ratchet member above the toothed rim, a polygonal groove defined in the ratchet member, and a second trench formed in the ratchet member above the polygonal groove.

A cap is covered on the rib of the driving head and includes a through orifice formed on a central portion of the cap, an open section defined on a rear end of the cap, a protruded section extending downwardly from a front end of the cap opposite to the open section of the cap, and an actuation extension extending outwardly from a bottom of the protruded section. The actuation extension contacts with an upper end of the first trench, the cap further includes two opposite openings corresponding to the two positioning orifices of the rib, respectively, so as to house two posts, wherein a part of each of the two posts extends out of each of the two opposite openings, and said each post inserts into each of the two positioning orifices.

A resilient element is defined between the second trench of the ratchet member and the cap.

DETAILED DESCRIPTION OF THE PREFERRED EMBODIMENTS

Figure 1:
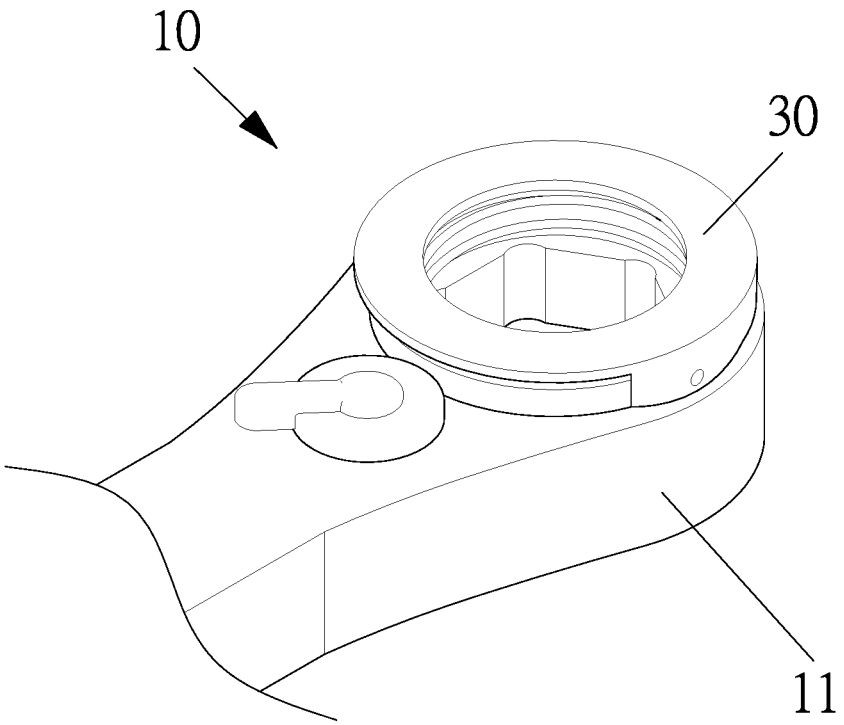
FIG. 1 is a perspective view showing the assembly of a locking structure for a hand tool according to a preferred embodiment of the present invention.
Figure 2:
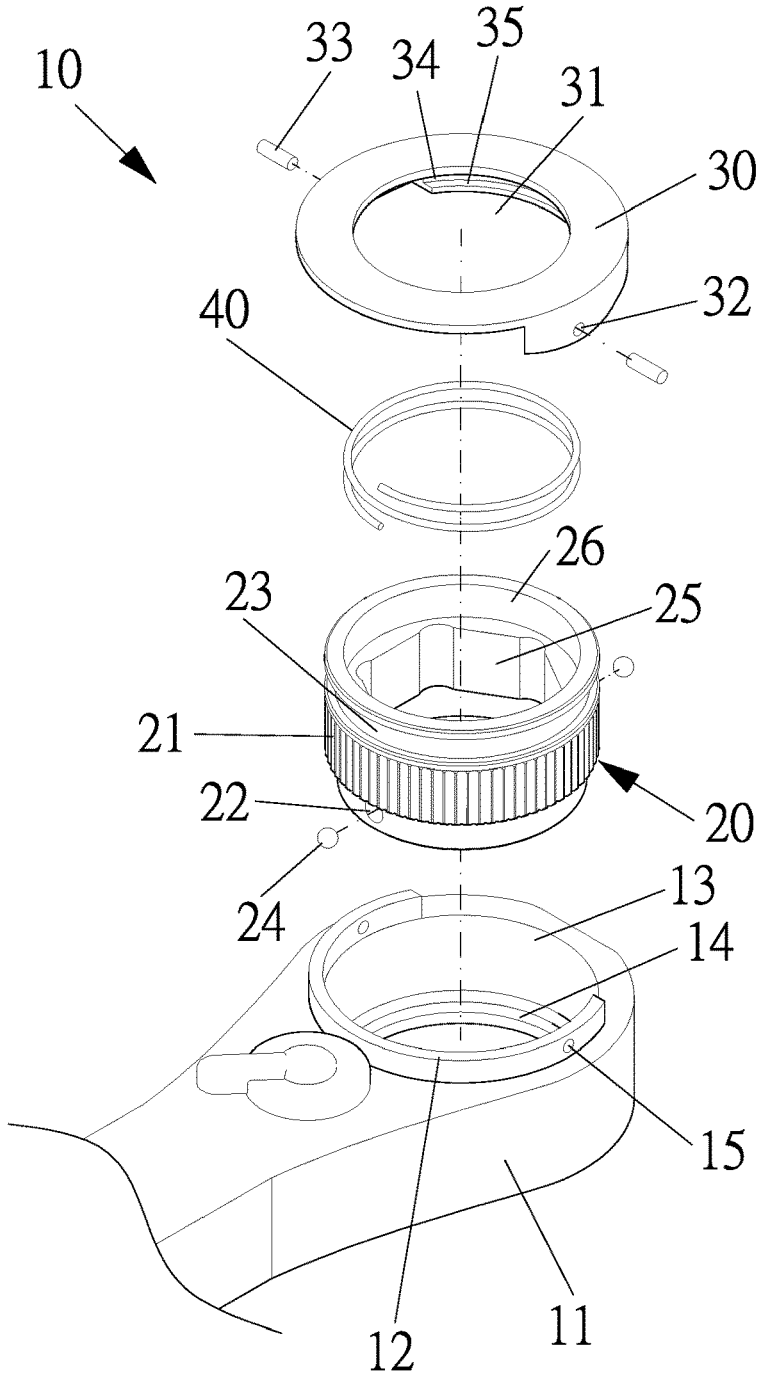
FIG. 2 is a perspective view showing the exploded components of the locking adjustment structure for the hand tool according to the preferred embodiment of the present invention.
Figure 3:
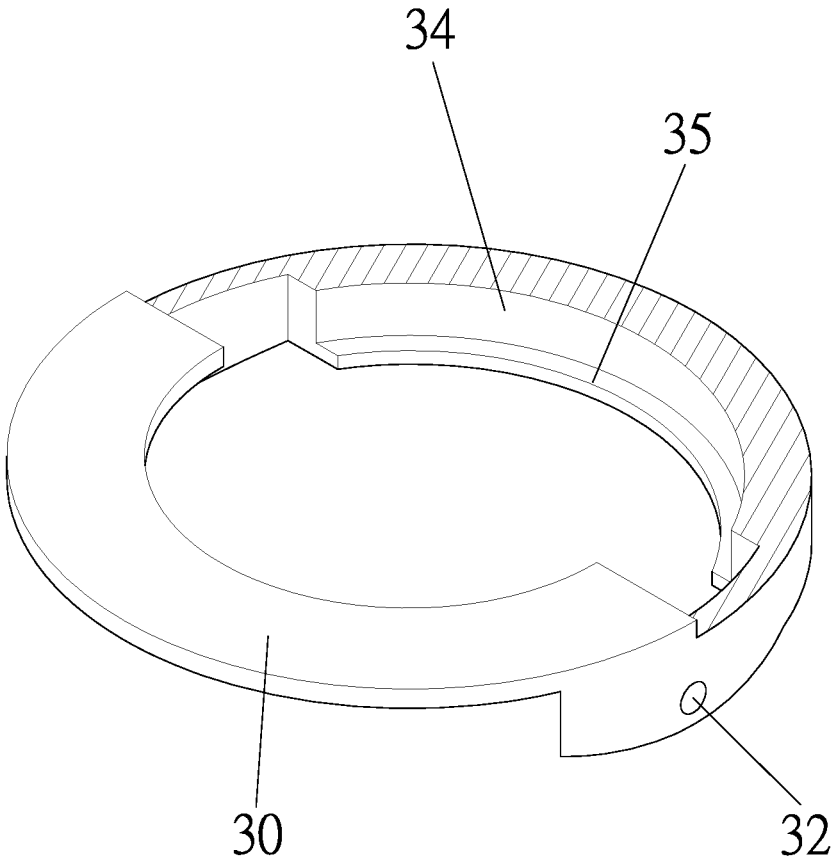
FIG. 3 is a cross-sectional perspective view showing the assembly of a part of the locking structure for the hand tool according to the preferred embodiment of the present invention.
Figure 4:
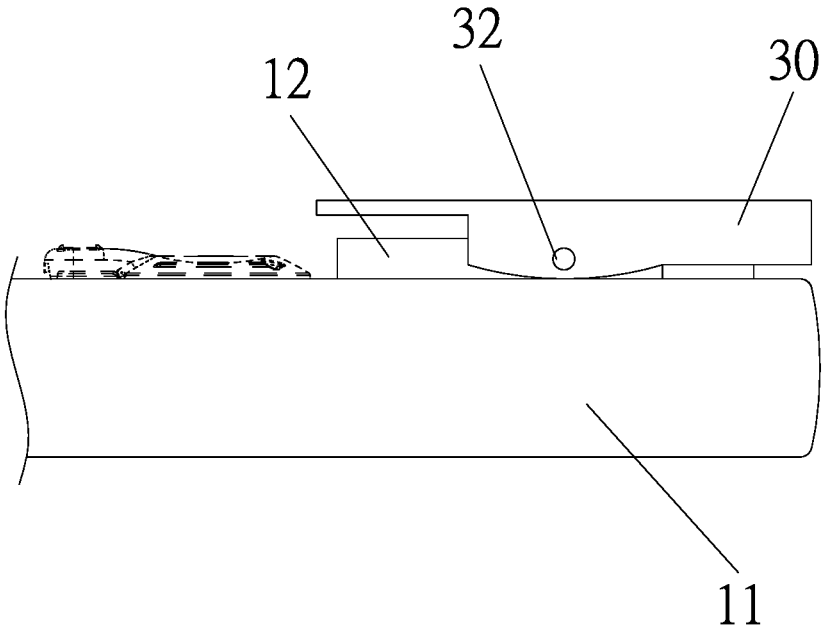
FIG. 4 is a side plane view showing the assembly of the locking structure for the hand tool according to the preferred embodiment of the present invention.
Figure 5:
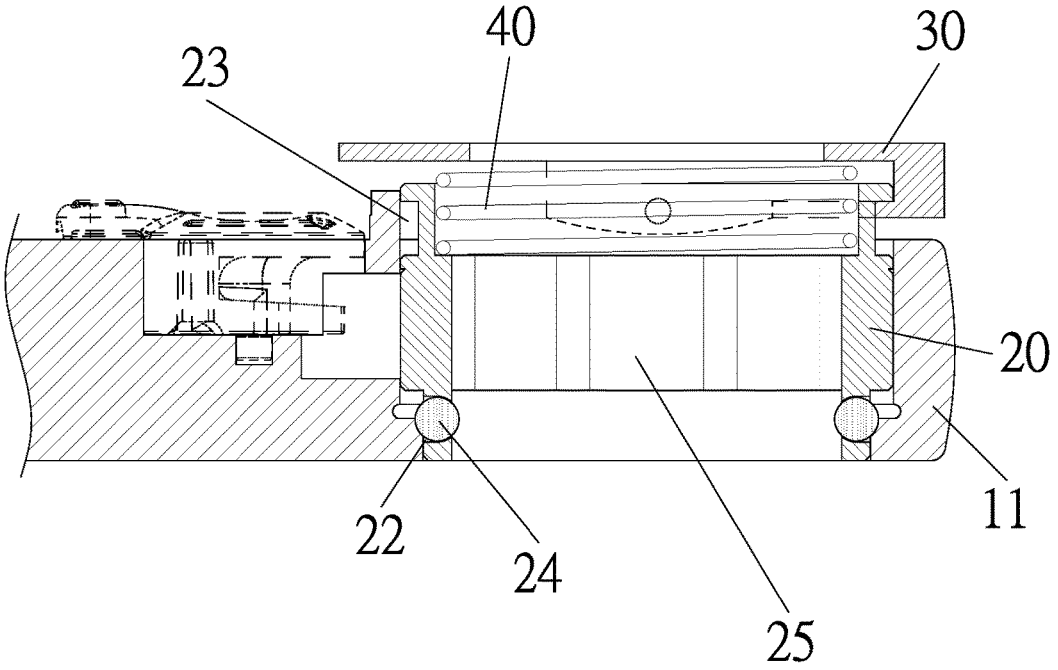
FIG. 5 is a cross sectional view showing the assembly of the locking structure for the hand tool according to the preferred embodiment of the present invention.
Figure 6:
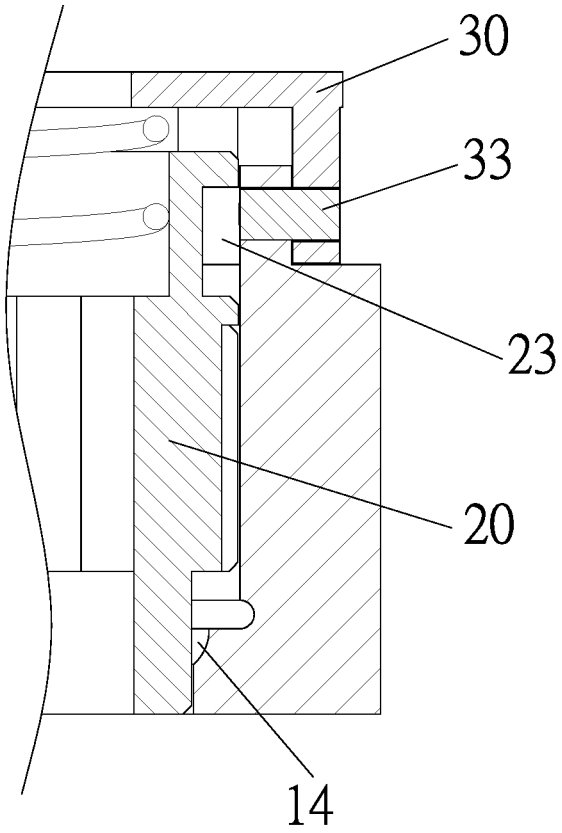
FIG. 6 is another cross sectional view showing the assembly of the locking structure for the hand tool according to the preferred embodiment of the present invention.
Figure 7:
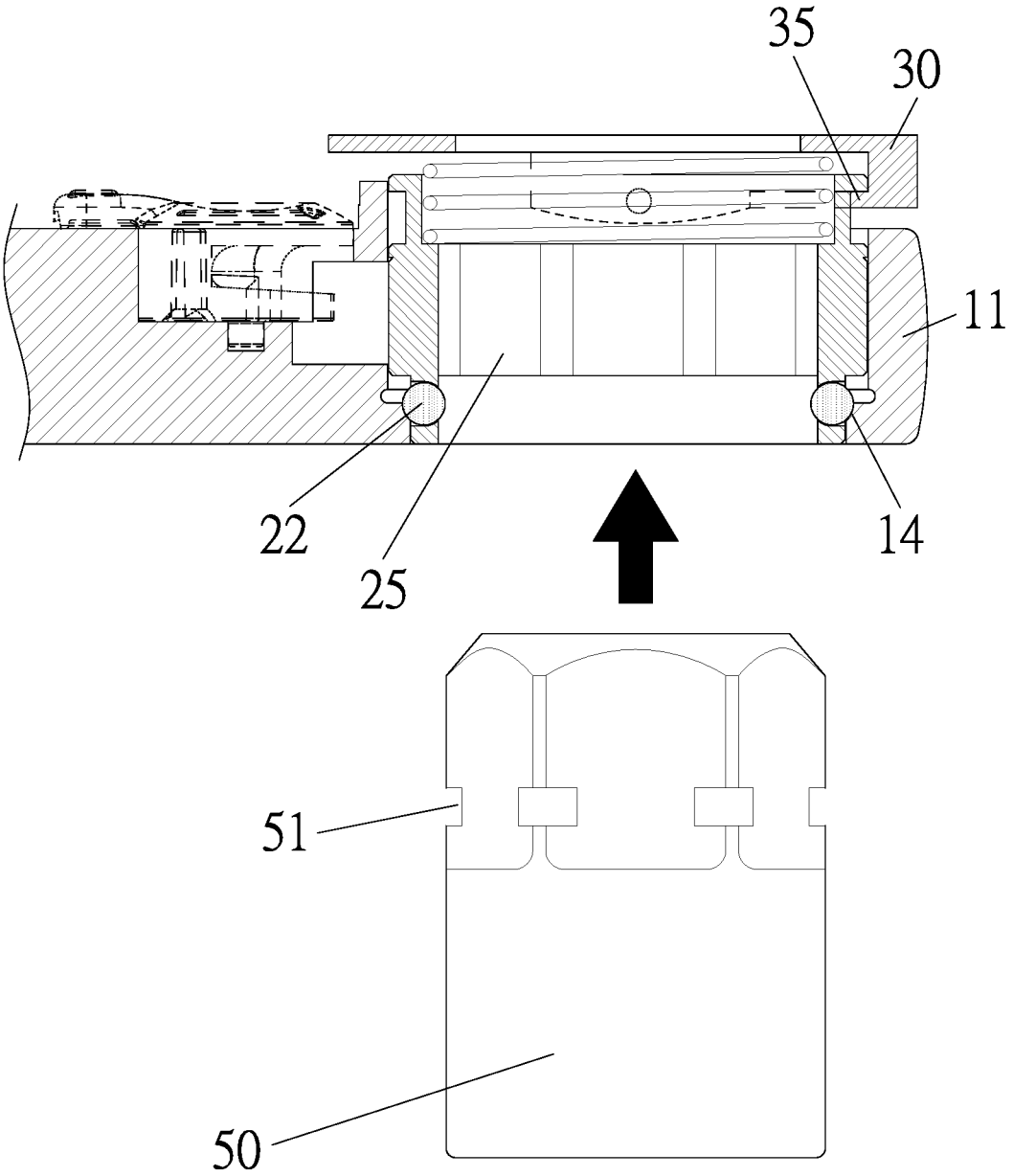
FIG. 7 is a cross sectional view showing the operation of the locking structure for the hand tool according to the preferred embodiment of the present invention.
Figure 8:
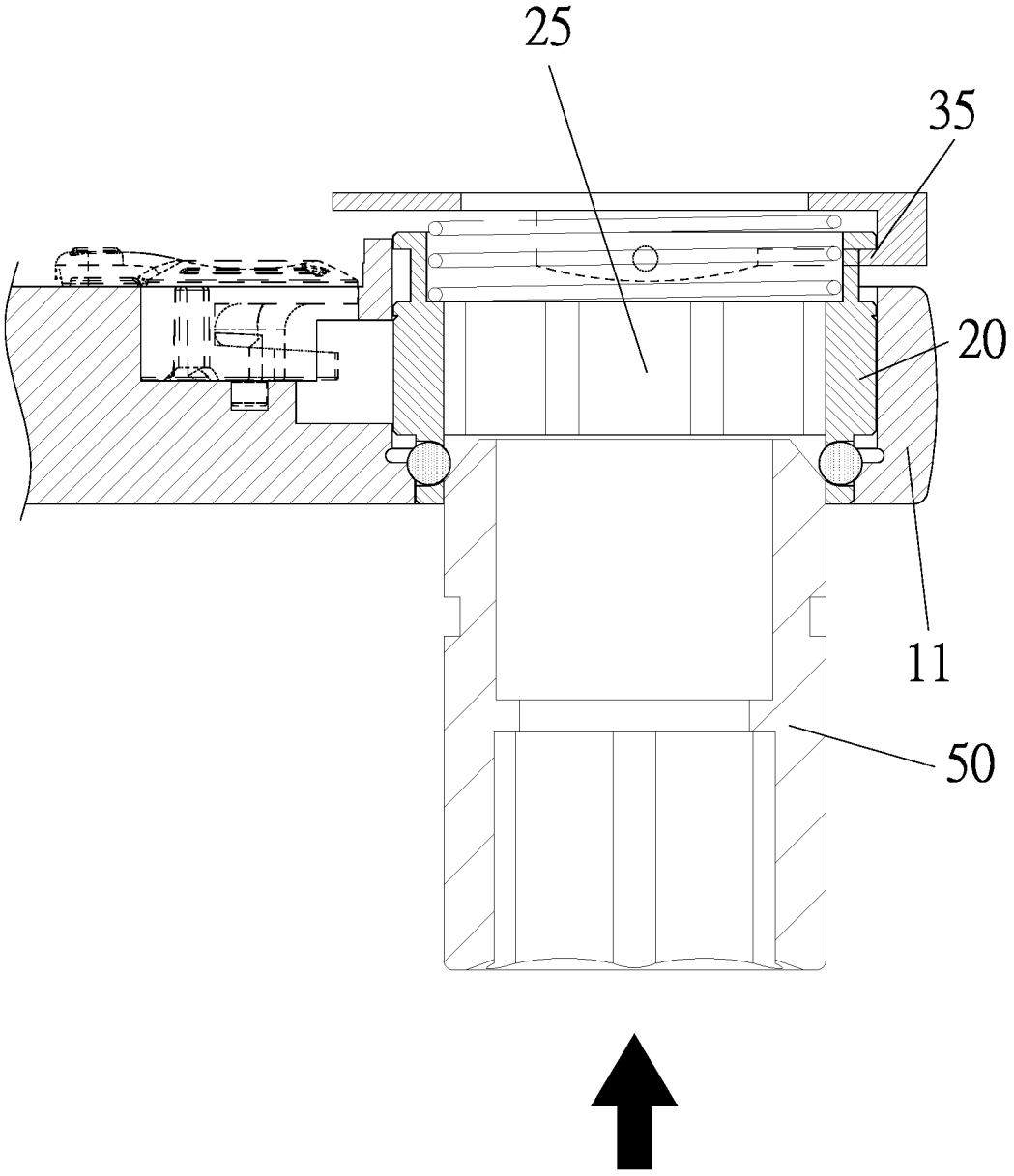
FIG. 8 is another cross sectional view showing the operation of the locking structure for the hand tool according to the preferred embodiment of the present invention.
Figure 9:
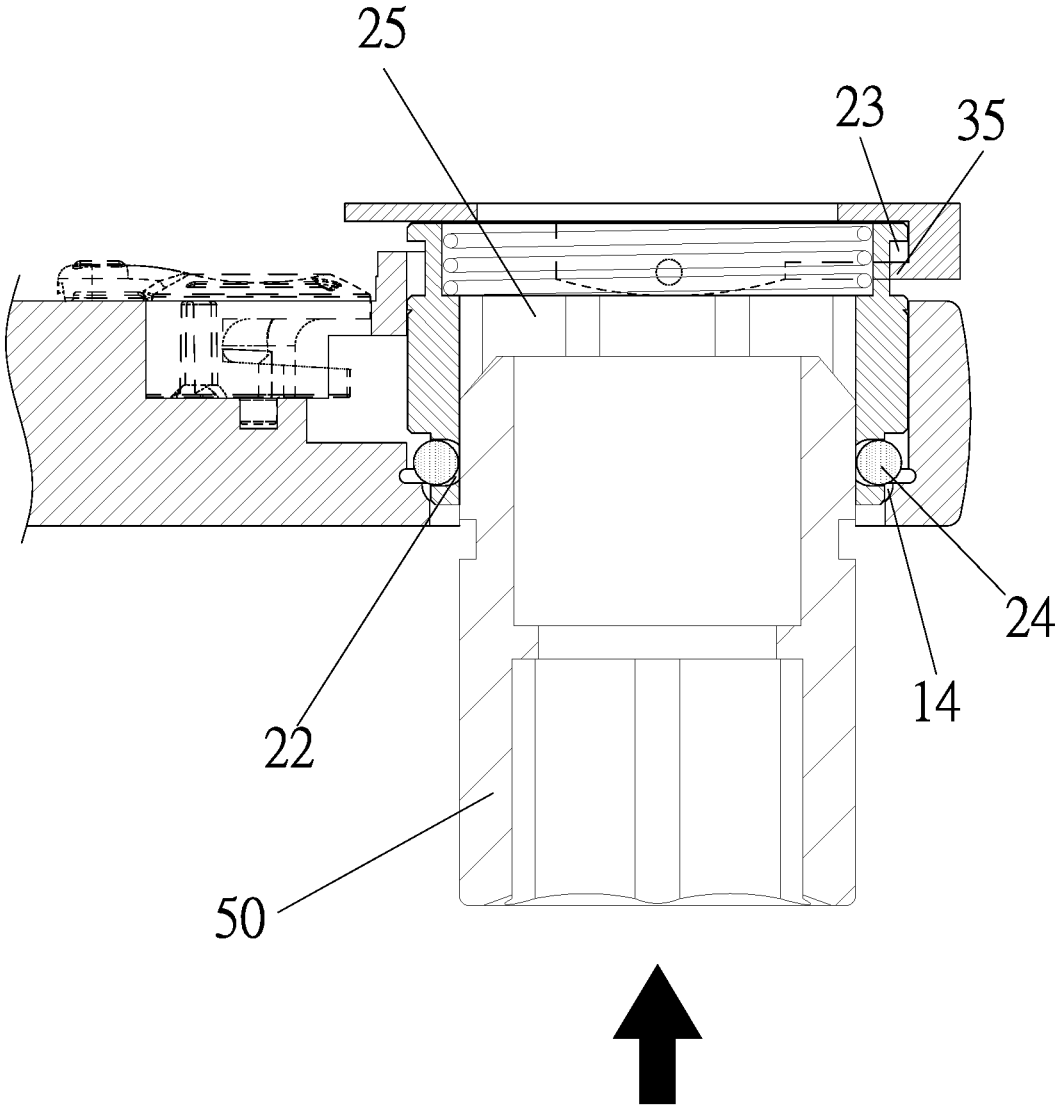
FIG. 9 to FIG. 12 are also another cross sectional view showing the operation of the locking structure for the hand tool according to the preferred embodiment of the present invention.
Figure 10:
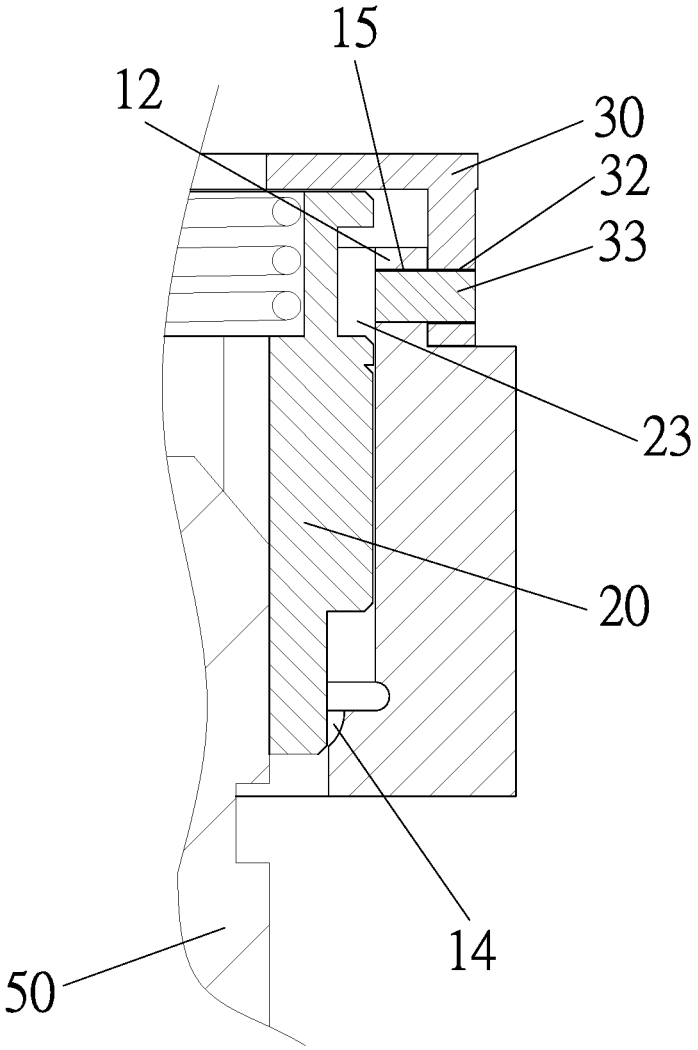
Figure 11:
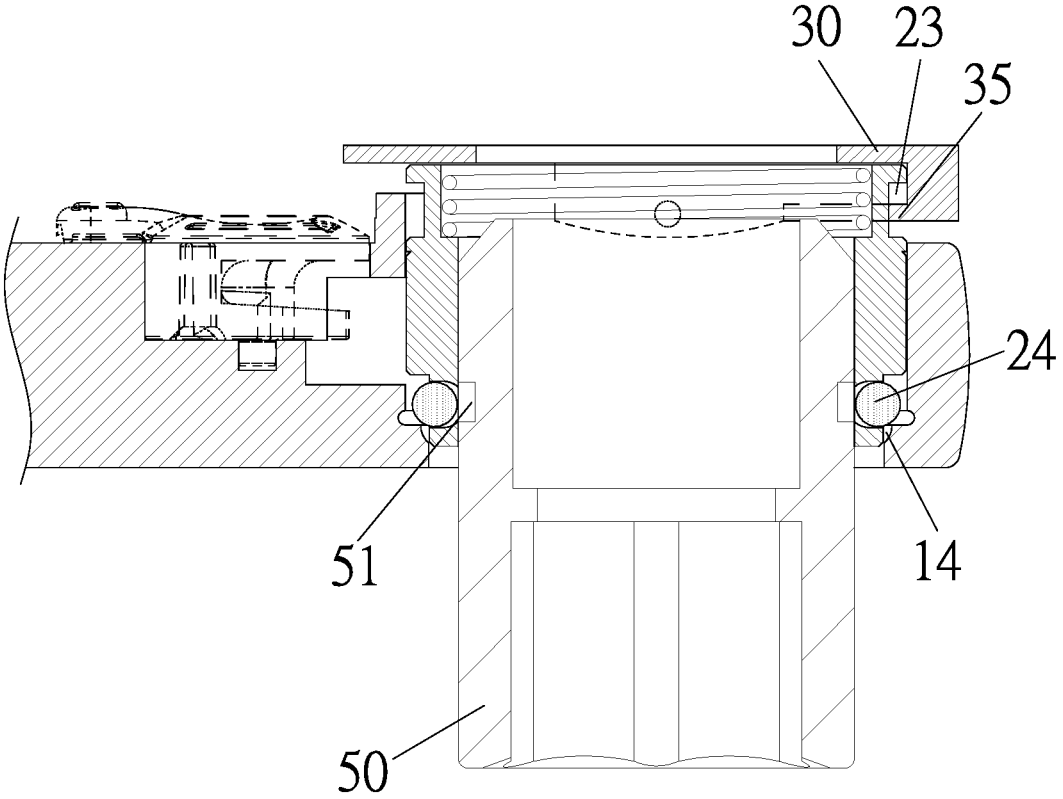
Figure 12:
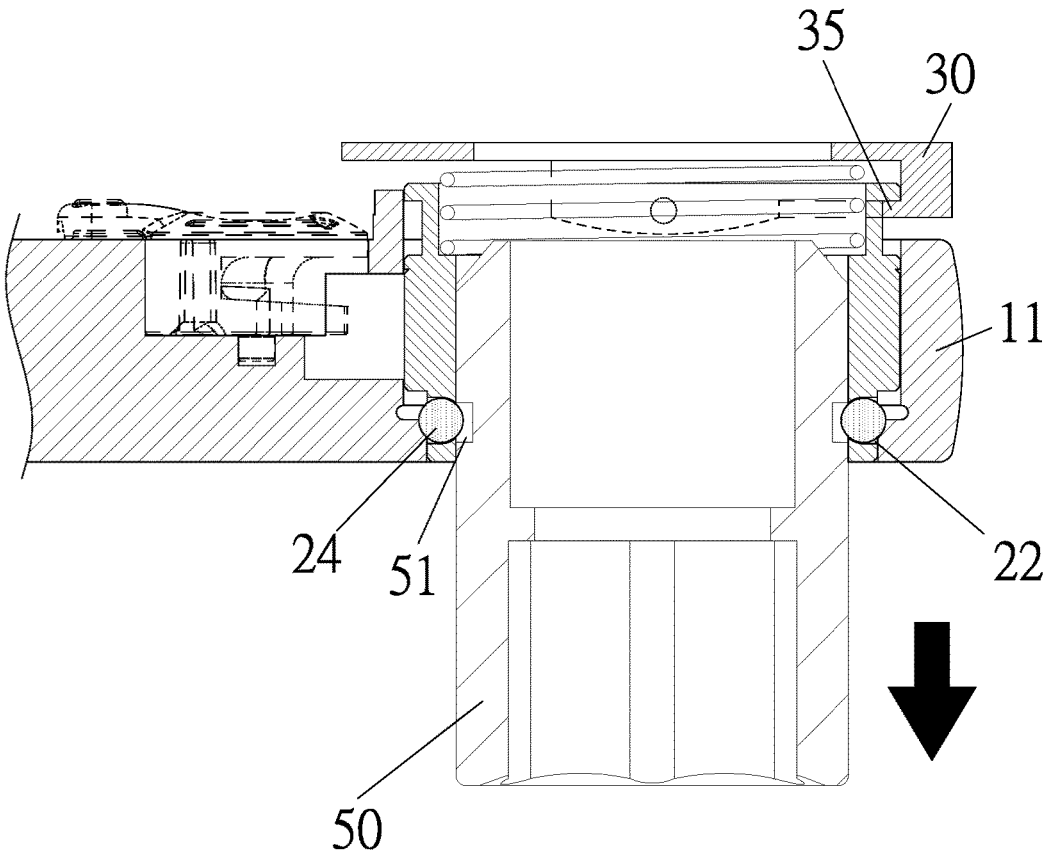

With reference to FIGS. 1 to 6, a locking structure for a hand tool according to a preferred embodiment of the present invention comprises: a body 10, and the body 10 includes a driving head 11 in which an accommodation chamber 13 is defined, the driving head 11 also includes a rib 12 extending upwardly thereon adjacent to the accommodation chamber 13, and between two ends of the rib 12 is defined an opening. The rib 12 has two positioning orifices 15 arranged adjacent to the two ends thereof, respectively. The accommodation chamber 13 has an obliquely arcuate groove 14 formed on a lower end thereof and accommodates a ratchet member 20. The ratchet member 20 has a toothed rim 21 arranged around a peripheral wall thereof, and the ratchet member 20 has two opposite apertures 22 defined on the peripheral wall of the ratchet member 20 below the toothed rim 21 and configured to accommodate two steel balls 24, respectively, wherein a part of each of the two steel balls 24 extends out of each of the two apertures 22. The ratchet member 20 further has a first trench 23 defined on the peripheral wall of the ratchet member 20 above the toothed rim 21, a polygonal groove 25 defined in the ratchet member 20, and a second trench 26 formed in the ratchet member 20 above the polygonal groove 25.

Furthermore, a cap 30 is covered on the rib 12 of the driving head 11 and includes a through orifice 31 formed on a central portion of the cap 30, an open section defined on a rear end of the cap 30, a protruded section 34 extending downwardly from a front end of the cap 30 opposite to the open section of the cap 30, and an actuation extension 35 extending outwardly from a bottom of the protruded section 34, wherein the actuation extension 35 contacts with an upper end of the first trench 23. The cap 30 further includes two opposite openings 32 corresponding to the two positioning orifices 15 of the rib 12, respectively, so as to house two posts 33, wherein a part of each of the two posts 33 extends out of each of the two opposite openings 32, and said each post 33 inserts into each of the two positioning orifices 15. Between the second trench 26 of the ratchet member 20 and the cap 30 is defined a resilient element 40.

Referring to FIGS. 7 to 12, when a connect column 50 is fitted into the polygonal groove 25, an upper end of the connect column 50 abuts against the two steel balls 24 so as to push the ratchet member 20, wherein the connect column 15 continuously pushes the two steel balls 24 to remove from the obliquely arcuate groove 14 and to move into the polygonal groove 25 until a slot 51 on an outer wall of the connect column 50 flushes with the two opposite apertures 22 of the ratchet member 20, such that the two steel balls 24 extends out of the two apertures 22, individually, and when the ratchet member 20 is pushed by the resilient member 40 to return back to an original position, the two steel balls 24 retain with the slot 51 of the connection column 50, thus fixing the connection column 50.

Figure 13:
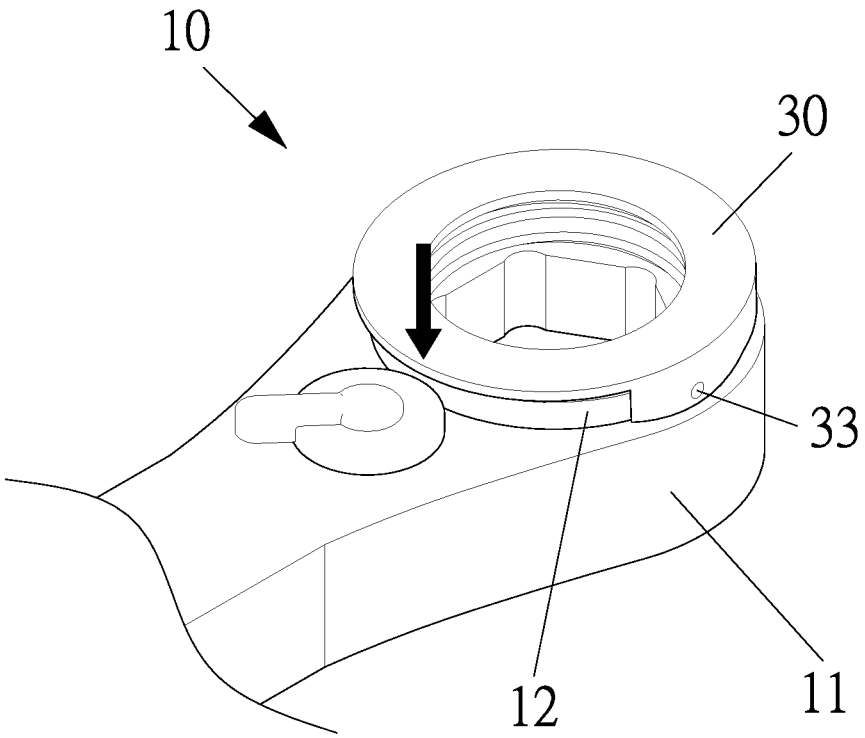
FIG. 13 is a perspective view showing the operation of the locking structure for the hand tool according to the preferred embodiment of the present invention.
Figure 14:
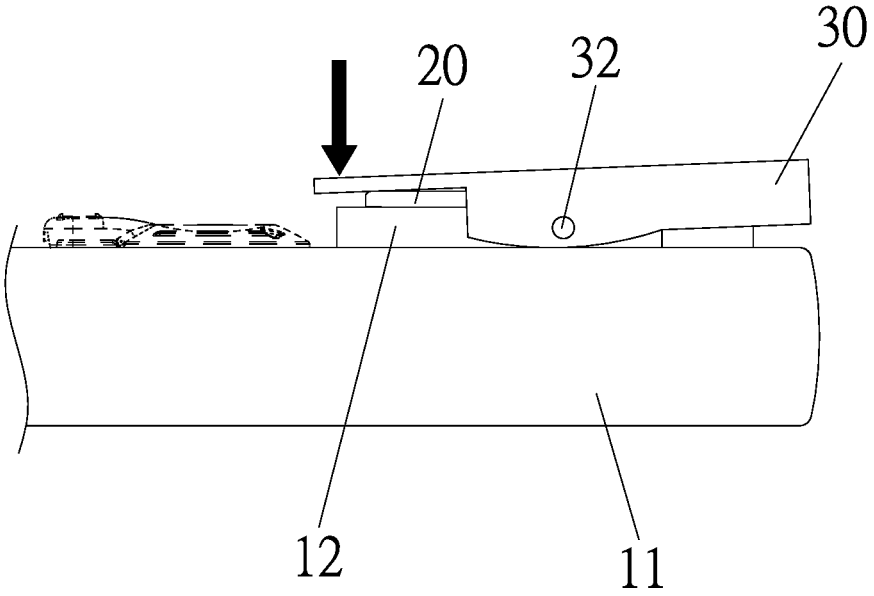
FIG. 14 is a side plane view showing the operation of the locking structure for the hand tool according to the preferred embodiment of the present invention.
Figure 15:
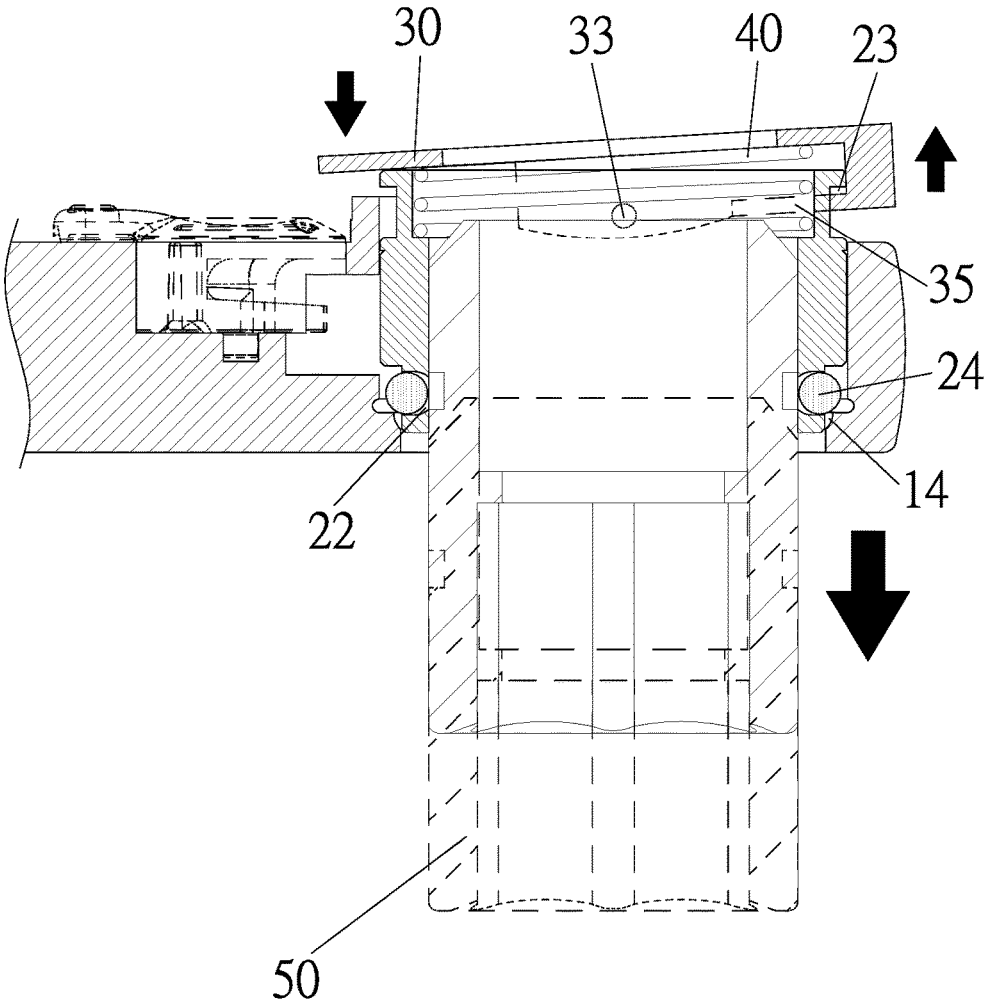
FIG. 15 is another cross sectional view showing the operation of the locking structure for the hand tool according to the preferred embodiment of the present invention.

As shown in FIGS. 13 to 15, when the connection column 50 retains with the ratchet member 20, a rear end of the cap 30 is pressed so that a front end of the cap 30 lifts upwardly by way of the two opposite openings 32 and the two posts 33, and the actuation extension 35 of the cap 30 abuts against the first trench 23 and pulls the ratchet member 20 to move inwardly, hence the two steel balls 24 remove from the obliquely arcuate groove 14, and the connection column 50 is released from the polygonal groove 25.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A locking structure for a hand tool comprising:

a body including a driving head, and the driving head including an accommodation chamber defined in the driving head, a rib extending upwardly on the driving head adjacent to the accommodation chamber, and between two ends of the rib being defined an opening, the rib having two positioning orifices arranged adjacent to the two ends of the rib, respectively;

the accommodation chamber having an obliquely arcuate groove formed on a lower end of the accommodation chamber and accommodating a ratchet member, wherein the ratchet member has a toothed rim arranged around a peripheral wall of the ratchet member, two opposite apertures defined on the peripheral wall of the ratchet member below the toothed rim and configured to accommodate two steel balls, respectively, wherein a part of each of the two steel balls extends out of each of the two apertures, and the ratchet member further has a first trench defined on the peripheral wall of the ratchet member above the toothed rim, a polygonal groove defined in the ratchet member, and a second trench formed in the ratchet member above the polygonal groove;

wherein a cap is covered on the rib of the driving head and includes a through orifice formed on a central portion of the cap, an open section defined on a rear end of the cap, a protruded section extending downwardly from a front end of the cap opposite to the open section of the cap, and an actuation extension extending outwardly from a bottom of the protruded section, wherein the actuation extension contacts with an upper end of the first trench, the cap further includes two opposite openings corresponding to the two positioning orifices of the rib, respectively, so as to house two posts, wherein a part of each of the two posts extends out of each of the two opposite openings, and said each post inserts into each of the two positioning orifices;

wherein a resilient element is defined between the second trench of the ratchet member and the cap.

2. The locking structure for the hand tool as claimed in claim 1, wherein when a connect column is fitted into the polygonal groove, an upper end of the connect column abuts against the two steel balls so as to push the ratchet member, wherein the connect column continuously pushes the two steel balls to remove from the obliquely arcuate groove and to move into the polygonal groove.

3. The locking structure for the hand tool as claimed in claim 1, wherein after the two steel balls remove from the obliquely arcuate groove, the connect column continuously move into the polygonal groove until a slot on an outer wall of the connect column flushes with the two opposite apertures of the ratchet member, such that the two steel balls extends out of the two apertures, individually, and when the ratchet member is pushed by the resilient member to return back to an original position, the two steel balls retain with the slot of the connection column.

4. The locking structure for the hand tool as claimed in claim 1, wherein when the connection column retains with the ratchet member, a rear end of the cap is pressed so that a front end of the cap lifts upwardly by way of the two opposite openings and the two posts, and the actuation extension of the cap abuts against the first trench and pulls the ratchet member to move inwardly, hence the two steel balls remove from the obliquely arcuate groove, and the connection column is released from the polygonal groove.

* * * * *